United States Patent [19]

Parsons

[11] Patent Number: 5,051,918

[45] Date of Patent: Sep. 24, 1991

[54] GAS TURBINE STALL/SURGE IDENTIFICATION AND RECOVERY

[75] Inventor: Douglas A. Parsons, Enfield, Conn.

[73] Assignee: United Technologies Corporation, Hartford, Conn.

[21] Appl. No.: 407,985

[22] Filed: Sep. 15, 1989

[51] Int. Cl.[5] ..... G05B 15/00; F01D 17/02

[52] U.S. Cl. ..... 364/494; 364/551.01; 73/117.2; 73/117.3; 60/39.091; 415/17

[58] Field of Search ..... 364/494, 551.01; 73/116, 117.2, 117.3, 117.4; 60/39.091; 415/17

[56] References Cited

U.S. PATENT DOCUMENTS

| | | | |
|---|---|---|---|
| 3,867,717 | 2/1975 | Moehring | 340/27 |
| 3,868,625 | 2/1975 | Speigner et al. | 340/27 SS |
| 4,060,979 | 12/1977 | Elsaesser et al. | 60/39.03 |
| 4,060,980 | 12/1977 | Elsaesser et al. | 60/39.03 |
| 4,083,235 | 4/1978 | Gallant | 73/117.3 |
| 4,117,668 | 10/1978 | Elsaesser | 60/39.03 |
| 4,118,926 | 10/1978 | Curvino et al. | 60/39.03 |
| 4,137,710 | 2/1979 | Preti et al. | 60/223 |
| 4,360,882 | 11/1982 | Stewart et al. | 364/494 |
| 4,427,896 | 1/1984 | Waldron | 364/494 |
| 4,449,360 | 5/1984 | Evans | 60/39.281 |
| 4,507,915 | 4/1985 | Evans | 60/39.281 |
| 4,550,564 | 11/1985 | Callahan et al. | 60/39.093 |
| 4,581,888 | 4/1986 | Schmitzer et al. | 60/39.091 |
| 4,608,860 | 9/1986 | Charrier et al. | 73/115 |
| 4,622,808 | 11/1986 | Kenison et al. | 60/39.29 |
| 4,635,209 | 1/1987 | Hwang et al. | 364/494 |
| 4,722,180 | 2/1988 | Lindler et al. | 60/39.03 |
| 4,768,338 | 9/1988 | Lindler et al. | 60/39.27 |
| 4,881,184 | 11/1989 | Abegg, et al. | 364/494 |

*Primary Examiner*—Parshotam S. Lall
*Assistant Examiner*—Brian M. Mattson
*Attorney, Agent, or Firm*—Richard H. Kosakowski

[57] ABSTRACT

Parameters indicative of gas turbine engine operational characteristics are sensed and the signals processed to derive further operational characteristic information therefrom, each information signal being compared in a subroutine to a corresponding threshold signal for exceedence thereof, the magnitude of each threshold signal being indicative of incipiency of compressor stall, a counter being incremented in the subroutine upon any threshold exceedence occurrence, the amount of counter increment depending on the ability of each information signal to predict the incipiency of stall, the higher the counter value the greater the stall incipiency. The counter is decremented during each subroutine execution, the counter value during the current subroutine execution being compared to that of the previous subroutine execution to determine the direction of stall incipiency. The counter is utilized as a bias signal to an engine acceleration schedule to vary the rate of acceleration as the counter is varied.

20 Claims, 5 Drawing Sheets

GAS TURBINE STALL/SURGE IDENTIFICATION AND RECOVERY

TECHNICAL FIELD

This invention relates to gas turbine engines, and more particularly to apparatus for providing identification of and recovery from a gas turbine compressor stall/surge condition.

BACKGROUND ART

Stall occurs in gas turbine engines when the compressor pressure ratio initially exceeds a critical value at a given speed, resulting in reduced flow capacity and efficiency. This causes a number of compressor blades to "stall" with a resulting momentary compressor airflow reversal.

A stall/surge event may only take 50 milliseconds from beginning to end, although a series of these events may occur in rapid succession. If the stall is undetected and allowed to continue, the combustor temperatures and the vibratory stresses induced in the compressor may become sufficiently high to cause engine damage.

An engine experiencing a recoverable stall will return to normal operation on its own, although the pilot may experience a noticeable loss of power. In contrast, a nonrecoverable stall cannot automatically correct itself and requires the pilot to turn off and restart the engine.

A stall may be alleviated by reducing the fuel to the burners or by bleeding a portion of the compressor airflow. Either can be performed automatically by the fuel control. Alternatively, manual corrective action can be taken, e.g. the pilot cutting back on the throttle. In each case, a stall signal must be provided to the control.

In a craft, e.g. a helicopter, not equipped with a stall detection system, the pilot must monitor various parameters and decide on the incipiency of stall. However, this method is error-prone due to the rapidity with which the stall condition manifests itself. Thus, it is desired to have an automatic stall detection system on board to accurately detect the stall incipiency.

Prior art stall detection systems typically sense a number of engine parameters and make a stall determination therefrom. However, these systems have varying degrees of stall predictability. For example, it is known to determine a stall from certain ranges of one or two parameters. However, this may give false stall indications since the parameter ranges may also be indicative of conditions other than stall. Also, a stall detection system using a small number of parameters is less sensitive to incipiency of stall and has less ability to operate under changing flight conditions. Further, since some parameters are worse indicators of stall than others, the use of these parameters increase the time to detect a stall. Thus, it is desired to improve upon the response time of these systems in making a fast and accurate determination of stall incipiency.

Once detected, the stall signal may be incorporated in a stall recovery system that initiates an automatic stall recovery sequence by, e.g. shutting off fuel, starting ignition, and reinitiating fuel flow (e.g. U.S. Pat. No. 4,118,926). However, such response is undesirable due to the loss of thrust.

DISCLOSURE OF INVENTION

An object of the present invention is the provision of a gas turbine engine stall detection system with an improved response time in accurately detecting incipient compressor stall. Further objects include providing a bias to the fuel control acceleration schedule based on the degree of stall incipiency.

According to the present invention, a number of parameters indicative of operational characteristics of a gas turbine engine are sensed and the signals processed to derive further operational characteristic information therefrom, each information signal being compared in a subroutine to a corresponding threshold signal for exceedence thereof, the magnitude of each threshold signal being indicative of incipiency of compressor stall, a counter being incremented in the subroutine upon any threshold exceedence occurrence, the amount of counter increment depending on the ability of each information signal to predict the incipiency of compressor stall, the counter output being indicative of incipiency of compressor stall in that the higher the counter value the greater the incipiency of compressor stall.

In further accord with the present invention, the counter is decremented during each subroutine execution, the counter value during the current execution of the subroutine being compared to the counter value during the previous execution of the subroutine to determine the direction of incipiency of compressor stall.

In still further accord with the present invention, the counter output is utilized as a bias signal to the output of an acceleration schedule of the gas turbine engine, the bias signal allowing for a lesser rate of acceleration as the counter is incremented, the bias signal allowing for a greater rate of acceleration as the counter is decremented.

The invention has utility in providing a fast and accurate indication of stall incipiency, which may then be used as a bias to an acceleration schedule within an engine fuel control. In this way, the engine acceleration is self-compensating for compressor stability. Also, the problems associated with having to reduce power demand or switching acceleration schedules upon stall are eliminated.

The present invention may be readily implemented in, e.g. a rotorcraft or aircraft digital fuel control by means of relatively simple program steps. However, the invention may also be implemented by means of discrete analog or digital hardware, if desired, utilizing only apparatus and techniques which are readily available and well known in the art, in light of the teachings which follow hereinafter.

These and other objects, features and advantages of the present invention will become more apparent in light of the detailed description of a best mode embodiment thereof, as illustrated in the accompanying drawing.

BEST MODE FOR CARRYING OUT THE INVENTION

Figure 1A:
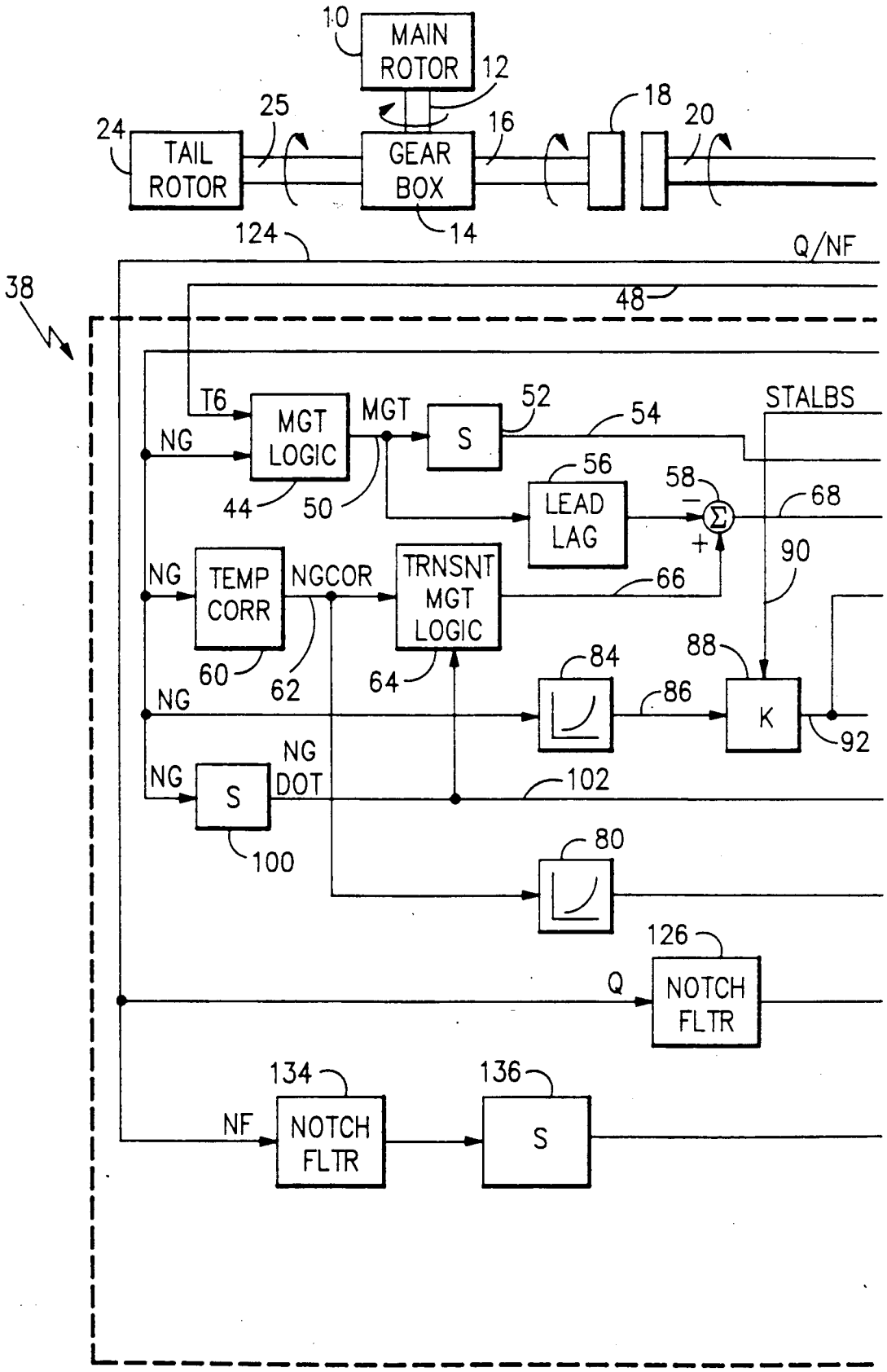
FIG. 1 is a combination of FIGS. 1A and 1B which are a simplified schematic block diagram of an exemplary embodiment of a helicopter rotor drive system including a free turbine gas engine and a fuel control containing logic components implementing the stall detection system of the present invention.
Figures 1, 1B:
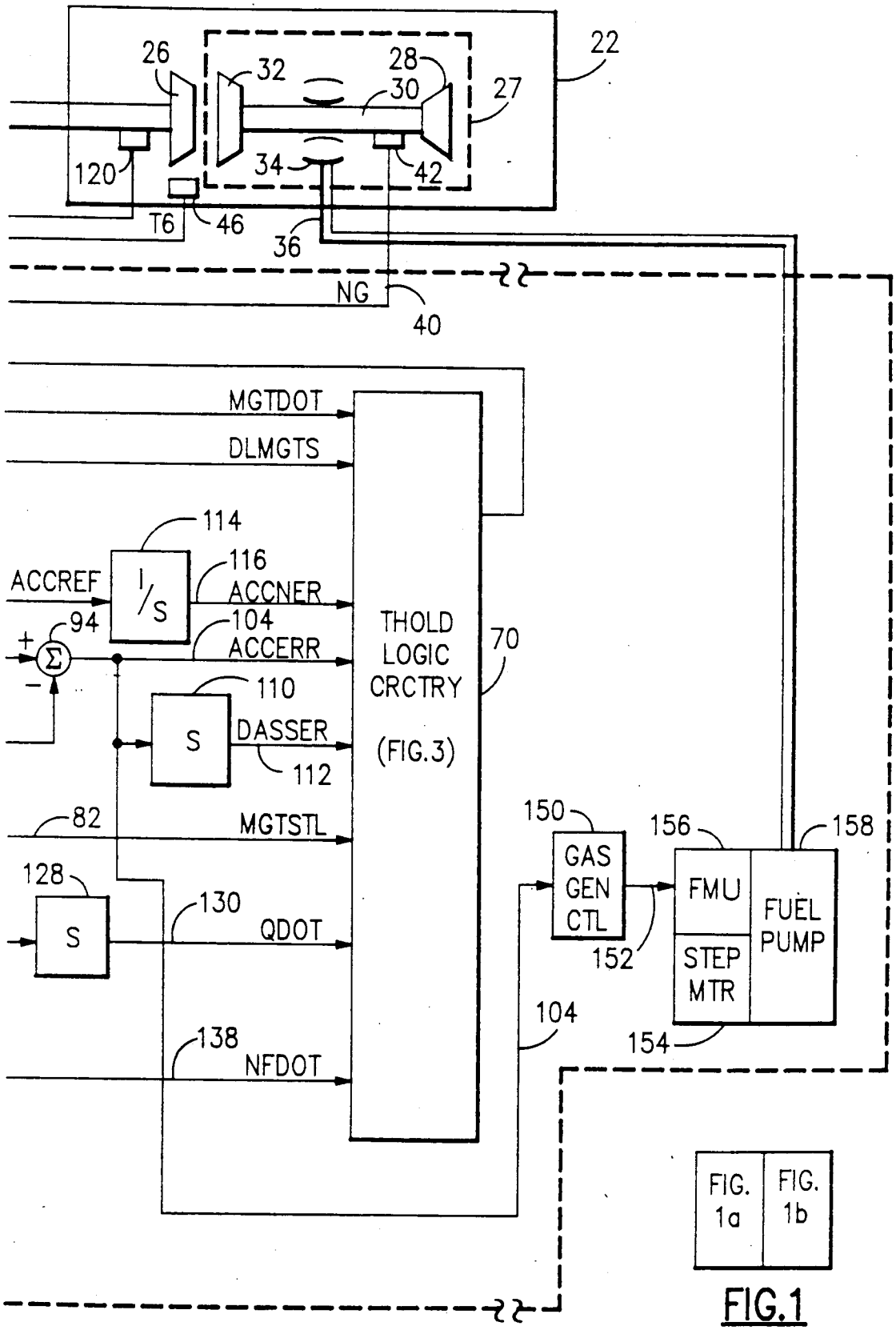

Referring to FIG. 1, a main rotor 10 of a helicopter connects through a shaft 12 to a gear box 14 which is driven by a shaft 16 through a clutch 18. The clutch 18 engages an output shaft 20 of an engine 22 when the engine speed equals or exceeds the rotor speed. The gear box 14 also drives a tail rotor 24 through a shaft 25 such that the main rotor 10 and tail rotor 24 are driven at speeds in a fixed relationship to one another.

The engine 22 may typically comprise a free turbine gas engine, such as the Model PW205B manufactured by Pratt & Whitney Canada. The engine output shaft 20 is driven by a free turbine 26, which in turn is driven by gases from a gas generator 27, having a compressor 28 connected by a shaft 30 to a turbine 32, and a burner section 34 to which fuel is applied by fuel lines 36 under the control of a fuel control 38. The fuel control 38 provides the correct fuel flow in the fuel lines 36 to maintain a desired free turbine speed (NF).

According to the invention, a signal (NG) indicative of the speed of the shaft 30 is presented on a line 40 by a speed sensor 42 to known MGT logic circuitry 44. A temperature sensor 46 provides a signal indicative of exhaust gas temperature (T6) on a line 48 to the MGT logic circuitry 44. The T6 sensor 46 typically comprises chromel/alumel-type thermocouples.

The MGT logic circuitry calculates a measured gas temperature (MGT) signal using a curve fit of NG together with T6 and ambient compensation, all in a manner that should be readily apparent to those skilled in the art. However, this method of providing an MGT signal is exemplary; any other suitable method may be used. MGT is provided on a line 50 to a derivative circuit 52, which provides a signal (MGTDOT) on a line 54 indicative of MGT rate of change. Although not shown, the derivative circuit 52 may also contain a low pass filter for noise suppression. MGT is also provided to a lead/lag circuit 56 whose output is fed to a summing junction 58.

NG is fed to a temperature correction circuit 60 which adjusts NG for variations in turbine inlet temperature and provides a signal (NGCOR) on a line 62. NGCOR is fed to known transient MGT logic circuitry 64 which calculates an expected value of MGT based on NGCOR, NG rate of change (NGDOT, described hereinafter) and inlet conditions. The transient MGT logic circuitry output is presented on a line 66 to the summing junction 58, whose output (DLMGTS) on a line 68 is fed to threshold logic circuitry 70, described in detail hereinafter.

NGCOR is also applied to a schedule 80 of corrected MGT rate of change versus NGCOR. The schedule output (MGTSTL) on a line 82 is fed to the threshold logic circuitry 70.

NG is also fed to an acceleration map 84, whose output on a line 86 is the derivative schedule of NG. Although not shown, NG may undergo temperature compensation before being applied to the map 84. The map output is presented to a gain stage 88, whose gain is modified by a signal (STALBS) on a line 90 from the threshold logic circuitry 70, in accordance with a further aspect of the present invention. As described in detail hereinafter, STALBS is derived from the output of a counter, the value of which is indicative of the operating condition of the gas generator 27. The gain stage output (ACCREF) is presented on a line 92 to a summing junction 94. Although not shown, ACCREF may undergo altitude and temperature compensation before being presented to the summing junction 94.

NG is differentiated by a derivative circuit 100, whose output signal (NGDOT) is presented on a line 102 to the summing junction 94, which subtracts NGDOT from ACCREF. The result of the subtraction (ACCERR) is indicative of NG speed rate error and is provided on a line 104 to the threshold logic circuitry 70. It is also provided to the transient MGT logic circuitry 64 and to a derivative circuit 110, whose output signal (DACCER) is indicative of acceleration error rate of change and is provided on a line 112 to the threshold logic circuitry. Although not shown, the derivative circuit 110 may have a low pass circuit associated therewith to reduce noise.

ACCREF is also fed to an integrator 114, whose output signal (ACCNER) is indicative of an acceleration error tracking term and is provided on a line 116 to the threshold logic circuitry. Although not shown, the integrator output may be compared to NG before being fed to the threshold logic circuitry.

A combination free turbine speed (NF) and torque (Q) sensor 120 is typically located between the gas generator 27 and shaft 20. The Q/NF sensor 120, which comprises in part a torque shaft comprising two concentric shafts affixed at a single end, measures the offset between the reference outer shaft and the load bearing inner shaft as a gear on each shaft passes by the magnetic pickup-type sensor. The Q/NF sensor provides a signal on one of the lines 124 to a known notch filter 126, which attenuates frequencies at and around the rotor system resonant frequency. The filter output is provided to a derivative circuit 128 whose output (QDOT) on a line 130 is indicative of torque rate of change.

The Q/NF sensor 120 also provides an NF signal on one of the lines 124 to a notch filter 134 which attenuates frequencies at and around the resonant frequency of the rotor system. The notch filter output is fed to a derivative circuit 136, whose output (NFDOT) on a line 138 is indicative of NF rate of change.

ACCERR is also provided to known gas generator control logic circuitry 150 in the fuel control 38. The control logic circuitry 150, which forms no part of the present invention, may also have as inputs (not shown) typical engine parameters, e.g. NG, NF, etc. in controlling the engine 22 accordingly in a manner that should be readily apparent to those skilled in the art. For example, the control logic circuitry may integrate ACCERR and use the integrator output to generate a rate request on a line 152 to a known electromechanical stepper motor 154, which controls a fuel metering unit (FMU) 156. The FMU 156 controls the fuel pump 158 in metering fuel to the gas turbine engine burner 34.

Thus, a number of typical gas turbine engine parameters (e.g. Q, NF, NG, T6) are sensed, and the signals are processed using known techniques to derive engine operation intelligence signals therefrom (e.g. MGTDOT, DLMGTS, ACCNER, etc.). As described hereinafter, these intelligence signals are applied to the threshold logic circuitry 70 for comparison to threshold signals for determination of incipient compressor stall in accordance with the present invention.

Figure 2A:
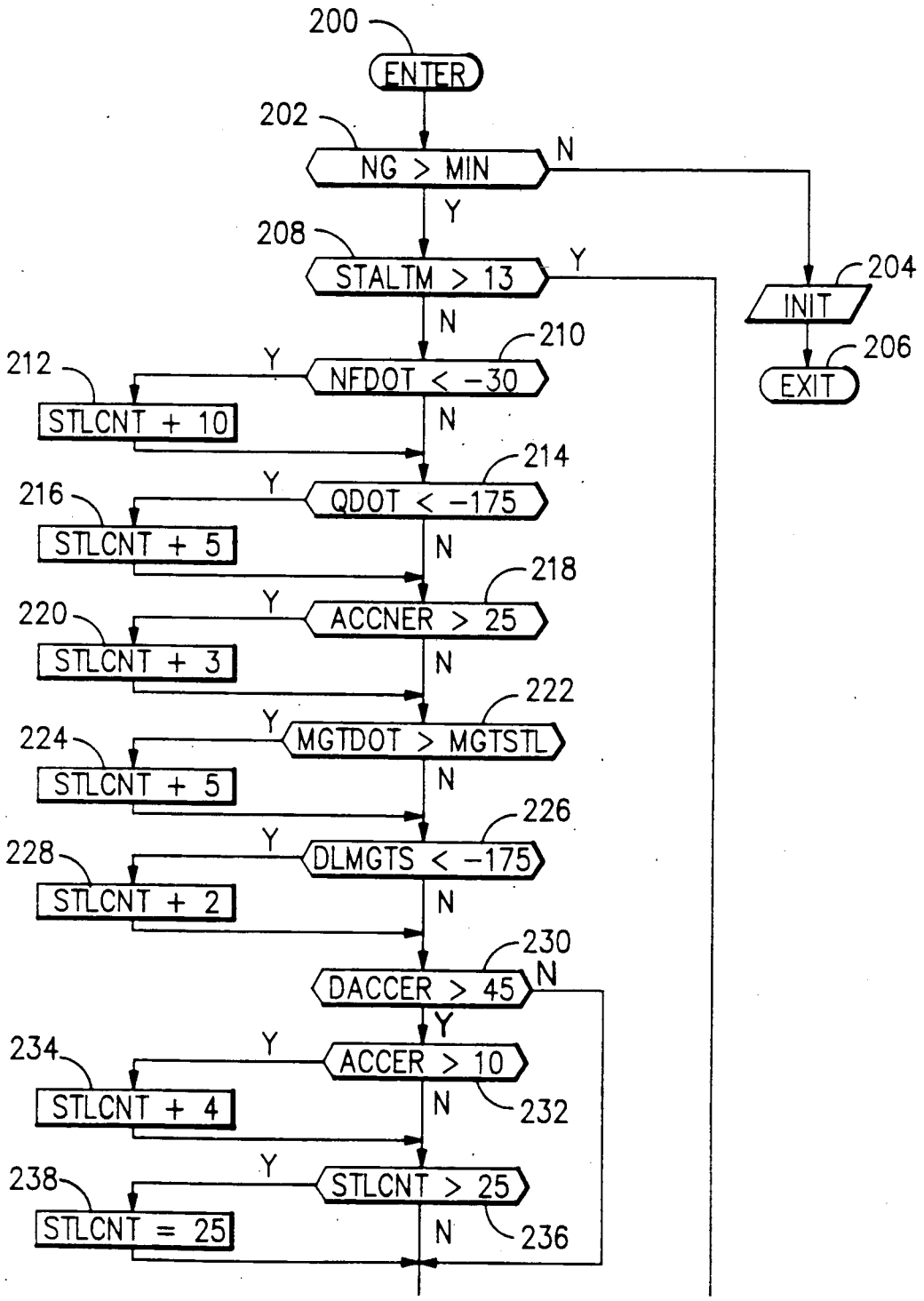
FIG. 2 is a combination of FIGS. 2A and 2B which are a flow diagram of computer program that implements a portion of the stall detection logic of FIG. 1.
Figures 2, 2B:
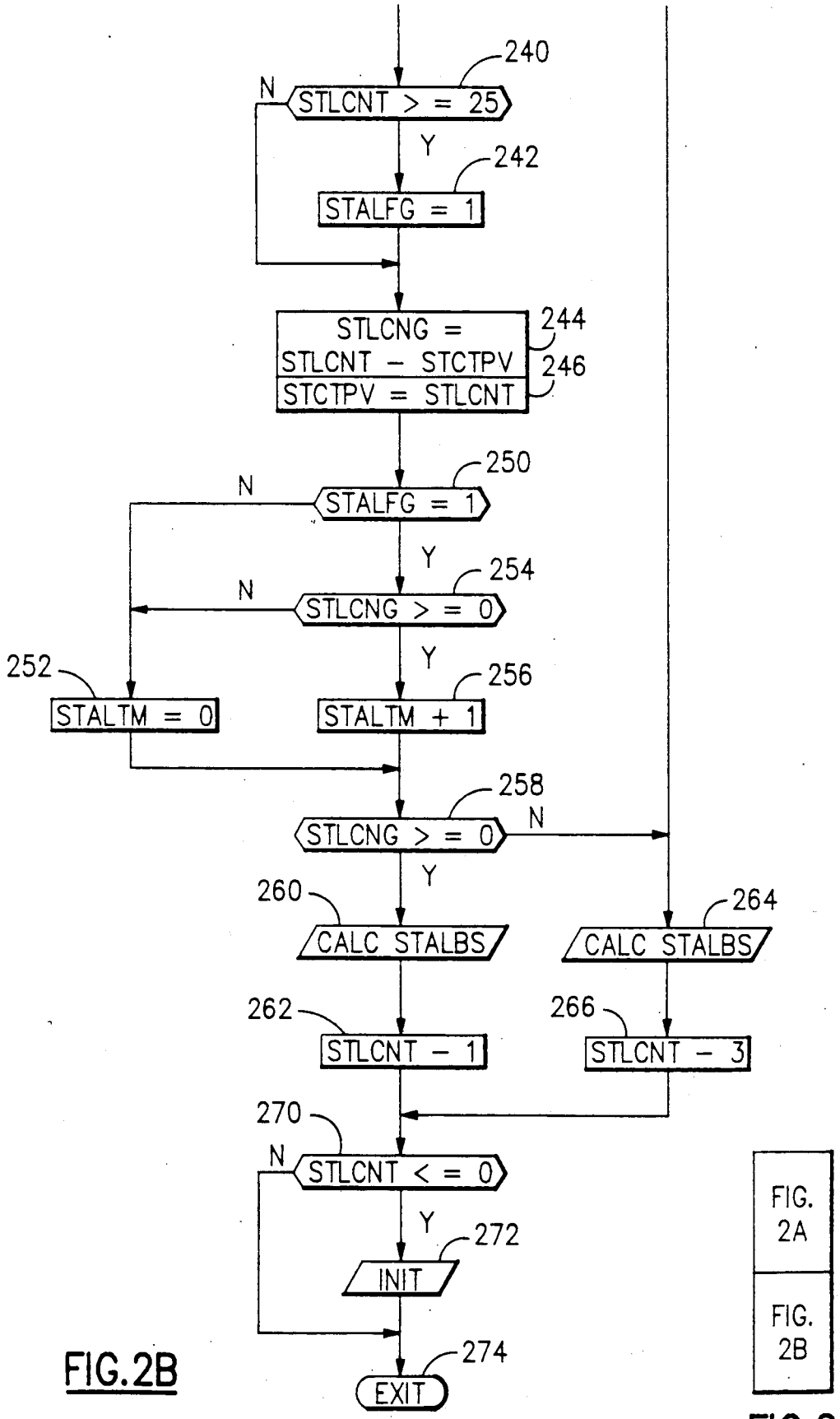
Figure 3:
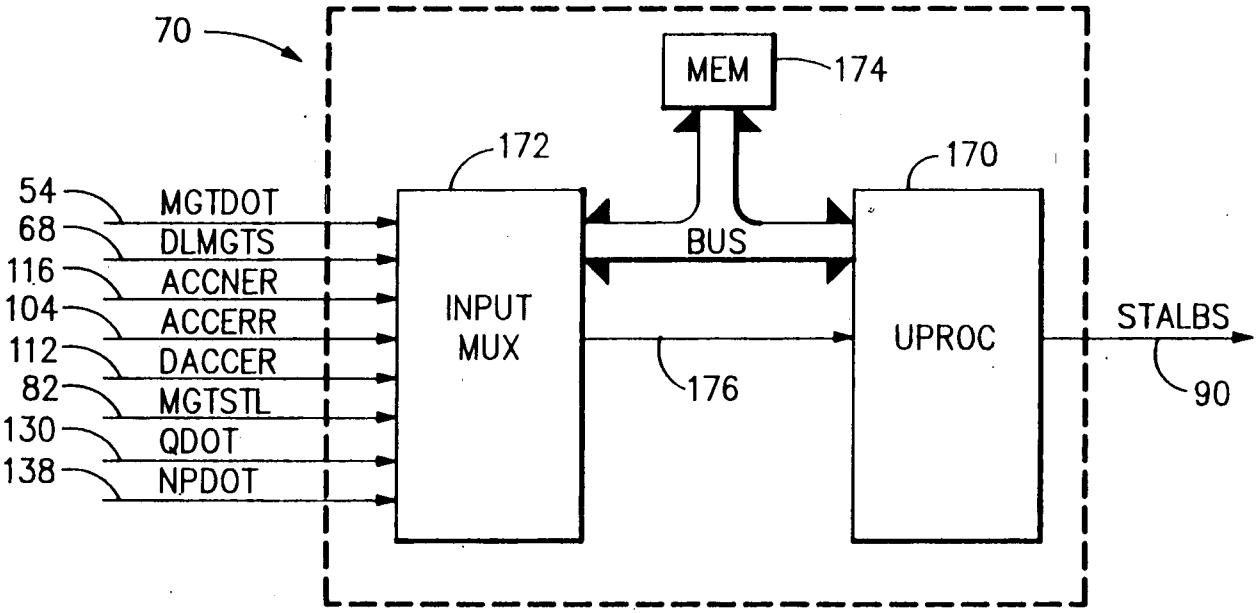
FIG. 3 is a simplified schematic block diagram of selected elements of the fuel control of FIG. 1.

Referring to FIG. 3, the threshold logic circuitry 70 may comprise a known microprocessor 170 (UPROC) for executing the algorithmic subroutine of FIG. 2. Also included are associated support components such as an input latch 172 for selecting from among the inputs, and memory 174 for storing counters, variables, and predetermined thresholds. The selected input signal is fed on a line 176 to the UPROC 170 which processes the signals in accordance with the subroutine of FIG. 2. The STALBS bias signal is output from the UPROC on the line 90.

The subroutine of FIG. 2 may be one of several that the UPROC executes in an iterative sequence in implementing the control laws for the gas turbine engine. It follows that FIG. 3 is not intended to be exclusive of other, non-illustrated UPROC input or output signals, these signals being necessary to effectuate control of the gas turbine engine.

Beginning after an enter step 200 in FIG. 2, the UPROC checks, in a test 202, if the value of NG exceeds a predetermined minimum value. If not, the UPROC initializes, in a routine 204, counters and variables stored in memory 174 and used hereinafter in the subroutine. The subroutine then exits in a step 206.

If NG exceeds the value, the UPROC checks, in a test 208, if the counter STALTM (initialized to zero in the routine 204) is greater than a predetermined value of 13. If so, the subroutine branches to a portion of the subroutine described hereinafter which calculates STALBS. STALTM indicates the amount of time the compressor is in a stall condition. As described hereinafter, STALTM is incremented by one each time the subroutine of FIG. 2 is executed in which a stall is present.

If STALTM is less than 13, NFDOT is compared, in a test 210, to a predetermined threshold value of −30% NF/SEC. If less than the threshold, the counter STLCNT (initialized to zero in the routine 204) is incremented by ten in a step 212. If greater than the threshold, step 212 is bypassed. Thus, NFDOT exceeding the threshold in a negative direction is an indication of an incipient stall condition. In this case, NFDOT exceedence is determined to be a relatively good indicator of incipient compressor stall since STLCNT is incremented by ten. As described hereinafter, other threshold exceedences increment the counter in varying amounts based on the signal's ability to predict a stall. However, it is to be understood that the actual threshold values and counter increment values disclosed herein are exemplary. It suffices for the present invention that each signal be compared to a threshold and a counter incremented upon exceedence thereof.

The UPROC next compares QDOT, in a test 214, to a threshold of −175% Q/SEC. If less than the threshold, STLCNT is incremented by five in a step 216. If greater than the threshold, step 216 is bypassed. The UPROC then compares ACCNER, in a test 218, to a threshold of 25% NG. If greater than the threshold, STLCNT is incremented by three in a step 220. If less than the threshold, step 220 is bypassed and the UPROC compares MGTDOT, in a test 222, to the current value of MGTSTL. If greater than the threshold, STLCNT is incremented by five in a step 224. If less than the threshold, step 224 is bypassed.

The UPROC then compares DLMGTS, in a test 226, to a threshold of −175 DEG C. If less than the threshold, STLCNT is incremented by two in a step 228. If greater than the threshold, step 228 is bypassed and the UPROC compares DACCER, in a test 230, to a threshold of 45% NG/SEC/SEC. If DACCER is greater than the threshold, the UPROC compares ACCERR, in a test 232, to a threshold of 10% NG/SEC. If DACCER is less than the threshold, step 232 is bypassed.

If ACCERR is greater than the threshold, STLCNT is incremented by four in a step 234. If ACCERR is less than the threshold, step 234 is bypassed. Next, the UPROC checks, in a test 236, if the value of STLCNT is greater than 25. If so, STLCNT is set equal to 25 in a step 238, the step 238 being bypassed, however, if STLCNT is less than or equal to 25. The UPROC then checks, in a test 240, if STLCNT is greater or equal to 25. If so, a variable STALFG (initially set to zero in the routine 204) is set to one in a step 242, STALFG equals one indicating a stall. If STLCNT is less than 25, step 242 is bypassed.

Next, the UPROC calculates, in a step 244, the value of the stall change indication counter, STLCNG, by subtracting the past value of STLCNT contained in the variable STCTPV (initially set to zero in the routine 204) from STLCNT. A positive value of STLCNG indicates a stall identification is in progress, while a negative value of STLCNG indicates a stall recovery is in progress. The value of STCTPV is then set equal to STLCNT in a step 246.

The UPROC then checks, in a test 250, if the value of STALFG equals one. If not, the value of STALTM is set equal to zero in a step 252. If STALFG equals one, the UPROC checks, in a test 254, if STLCNG is greater or equal to zero. If not, the step 252 is executed; if so, STALTM is set equal to one in a step 256.

Next, the UPROC checks, in a test 258, if STLCNG is greater than or equal to zero. If so, a routine 260 calculates the value of STALBS. STALBS may be calculated from an acceleration schedule in a manner which should be apparent to one of ordinary skill in the art. As STLCNT is incremented, STALBS increases the bias to the gain stage 88 (FIG. 1) allowing for a slower rate of engine acceleration. The opposite situation is true when STLCNT is decremented. STLCNT is then reduced by one in a step 262.

If STLCNG is less than zero as a result of the test 258, a routine 264 calculates the value of STALBS in a similar manner and STLCNT is decremented by three in a step 266. The difference in the STLCNT decrement amount in the steps 262, 266 is due to the fact that a greater STLCNT decrement value is desired if a stall recovery rather than a stall identification is in progress.

Returning to the test 208, if STALTM is greater than the predetermined value of 13, the calculate STALBS routine 264 and the decrement STLCNT step 266 are then executed instead of the steps 210–258 since the compressor has been identified to be in a stall for a sufficient amount of time. This allows for a faster rate of stall recovery.

Next, the UPROC checks, in a test 270, if STLCNT is less than or equal to zero. If so, then the engine has recovered from the stall condition, and an initialization routine 272 is executed where STLCNT, STALFG, STLCNG, and STALTM are all set to zero. The subroutine then exits in a step 274. If STLCNT is greater than zero, the initialization routine is bypassed, and the subroutine exits in the step.

Thus, it can be seen that STLCNT is incremented upon each exceedence by the threshold logic circuitry input signals of the corresponding threshold signals. In the exemplary embodiment of FIG. 2, a stall condition is indicated when STLCNT reaches a value of 25. A STLCNT value less than 25 is indicative of the incipiency of compressor stall, the incipiency increasing with a higher value of STLCNT. From STLCNT, the signal STALBS is calculated and used to gain modify the acceleration schedule output, thus making the acceleration of the fuel control self-compensating for stall incipiency.

It is to be understood that, for the broadest scope of the invention, it suffice that the STLCNT counter output be indicative of incipient compressor stall. Thus, the STALBS signal, which is derived from the counter output, forms no part of the broadest scope of the invention. Instead, the counter output may, if desired, effectuate an indication of or automatic recovery from compressor stall. For example, the counter output may trigger a visual/audio indication of stall incipiency to the pilot in the cockpit.

The exemplary embodiment of the threshold logic circuitry described herein may be implemented within a software program of a microprocessor-based digital fuel control computer, e.g. a Model EEC139 flight control manufactured by Hamilton Standard. The particular characteristics of the components comprising the fuel control are irrelevant for practicing the present invention. Also, the invention is described for use on a particular turboshaft engine; however, the invention is applicable to any gas turbine cycle engine.

It is to be understood that the engine parameter signals illustrated of FIG. 1 are strictly exemplary; if desired, other available parameters (e.g. compressor pressure, turbine inlet temperature) may be used, these parameters being processed in a similar manner using known techniques to derive maximum engine operation information therefrom and being subsequently checked for threshold exceedence in accordance with the present invention.

FIG. 1 illustrates the processing of the engine parameters being carried out in an analog fashion. However, these functions may be performed using software program steps in a suitable digital control computer. Furthermore, the invention may be implemented with dedicated analog and/or digital hardware, if desired, in an appropriate fashion which should be readily apparent to those skilled in the art in light of the description hereinbefore. All of the foregoing changes and variations are irrelevant to the present invention; it suffices that a number of engine parameters be sensed, signals indicative thereof be processed and then compared to corresponding thresholds for exceedence thereof, and a counter incremented upon any threshold exceedence, the counter output being indicative of incipient compressor stall.

Although the invention has been shown and described with respect to a best mode embodiment thereof, it should be understood by those skilled in the art that the foregoing and various other changes, omissions, and additions in the form and detail thereof may be made therein without departing from the spirit and scope of the invention.

I claim:

1. Apparatus for detecting a compressor stall in a gas turbine engine having a plurality of parameters, each of the parameters being associated with a corresponding operational characteristic of the engine and having a magnitude associated therewith, comprising:

sensing means, for sensing the magnitude of each of the plurality of engine parameters, and for providing sensed parameter signals indicative thereof;

signal processing means, responsive to said sensed parameter signals, for processing each of said sensed parameter signals to derive information therefrom as to further operational characteristics of the engine, and for providing associated information signals indicative thereof, each of said information signals having a magnitude associated therewith; and threshold means, responsive to said information signals, for comparing in a subroutine the magnitude of said information signals for exceedence of a magnitude of a corresponding plurality of threshold signals and for incrementing a counter value upon any exceedence, the magnitude of each of said threshold signals being indicative of a corresponding magnitude of incipiency of compressor stall, said counter value being incremented upon any exceedence by an amount corresponding to the ability of each of said information signals to indicate the incipiency of stall, said threshold means indicating a stall when said counter value meets or exceeds a certain amount.

2. The apparatus of claim 1, wherein said threshold signals include selected ones of said information signals, said threshold means comparing the magnitude of said information signals for exceedence of the magnitude of the corresponding ones of said selected ones of said information signals.

3. The apparatus of claim 2 , wherein said threshold means further comprises means for periodically executing said subroutine, said threshold means comparing said counter value during each current execution of said subroutine to said counter value during the previous execution of said subroutine to determine a direction of the stall incipiency, the incipiency direction determined to be increasing when said counter value during the current execution of said subroutine is greater than said counter value during the previous execution of said subroutine, the incipiency direction determined to be decreasing when said counter value during the current execution of said subroutine is less than said counter value during the previous execution of said subroutine.

4. The apparatus of claim 3, wherein said threshold means further comprises means for decrementing said counter value during each execution of said subroutine so as to adjust said counter value for the elapsed time between executions of said subroutine, said counter value being decremented by a first amount when said incipiency direction is determined to be increasing, said counter value being decremented by a second amount when said incipiency direction is determined to be decreasing, said second amount being greater than said first amount.

5. The apparatus of claim 4, wherein said sensing means includes first speed sensing means, responsive to speed of a compressor of the engine, for providing a compressor speed signal indicative thereof, the compressor speed being one of the plurality of engine parameters indicative of an operational characteristic of the engine.

6. The apparatus of claim 5, wherein said signal processing means further comprises:

acceleration schedule means, responsive to said compressor speed signal, for providing an acceleration signal having a magnitude indicative of the acceleration of said compressor speed signal; and gain means, responsive to said acceleration signal, for gain multiplying said acceleration signal and for providing a reference signal having a magnitude indicative thereof.

7. The apparatus of claim 6, wherein said threshold means further comprises means for providing to said gain means a bias signal proportional to the magnitude of said counter value, said gain means being responsive thereto for gain multiplying said acceleration signal in accordance therewith and for providing said reference signal indicative thereof, said bias signal allowing for a lesser value of said reference signal as said counter value is incremented, said bias signal allowing for a greater value of said reference signal as said counter value is decremented.

8. The apparatus of claim 7, wherein said signal processing means further comprises means for differentiating with respect to time said compressor speed signal, and for providing a differentiated compressor speed signal having a magnitude indicative thereof.

9. The apparatus of claim 8, wherein said signal processing means further comprises means for subtracting said differentiated compressor speed signal from said reference signal and for providing an acceleration error signal having a magnitude in accordance therewith.

10. The apparatus of claim 9, wherein said signal processing means further comprises means for differentiating with respect to time said acceleration error signal, and for providing a differentiated acceleration error signal having a magnitude indicative thereof, said threshold means comparing for exceedence the magnitude of said differentiated acceleration error signal to the magnitude of a selected one of said threshold signals and, upon an exceedence thereby, said threshold means comparing for exceedence the magnitude of said acceleration error signal to the magnitude of a selected one of said threshold signals and incrementing said counter value upon an exceedence thereby.

11. The apparatus of claim 4, wherein said sensing means includes second speed sensing means, responsive to speed of a free turbine of the engine, for providing a turbine speed signal having a magnitude indicative thereof, the free turbine speed being one of the plurality of engine parameters indicative of an operational characteristic of the engine.

12. The apparatus of claim 11, wherein said signal processing means further comprises means for differentiating with respect to time said turbine speed signal and providing a differentiated turbine speed signal having a magnitude indicative thereof, said threshold means comparing the magnitude of said differentiated turbine speed signal to the magnitude of a selected one of said threshold signals for exceedence thereof and incrementing said counter value upon an exceedence thereby.

13. The apparatus of claim 4, wherein said sensing means includes torque sensing means, responsive to torque on a free turbine of the gas turbine engine, for providing a torque signal having a magnitude indicative thereof, the torque being one of the plurality of engine parameters indicative of an operational characteristic of the engine.

14. The apparatus of claim 13, wherein said signal processing means further comprises means for differentiating with respect to time said torque signal and providing a differentiated torque signal having a magnitude indicative thereof, said threshold means comparing for exceedence the magnitude of said differentiated torque signal to the magnitude of a selected one of said threshold signals and incrementing said counter value upon an exceedence thereby.

15. The apparatus of claim 5, wherein said signal processing means further comprises:

temperature correction means, responsive to said compressor speed signal, for providing a corrected compressor speed signal having a magnitude indicative thereof; and temperature schedule means, responsive to said corrected compressor speed signal, for providing a temperature rate of change signal as a function of the magnitude of said corrected compressor speed signal, said temperature rate of change signal comprising one of said still further selected ones of said information signals.

16. The apparatus of claim 15, wherein said sensing means includes temperature sensing means, responsive to gas temperature of the engine, for providing a gas temperature signal having a magnitude indicative thereof, the gas temperature being one of the plurality of engine parameters indicative of an operational characteristic of the engine.

17. The apparatus of claim 16, wherein said signal processing means further comprises means, responsive to said gas temperature signal and said compressor speed signal, for providing a measured gas temperature signal having a magnitude indicative of the measured gas temperature of the engine.

18. The apparatus of claim 17, wherein said signal processing means further comprises means for differentiating with respect to time said measured gas temperature signal and for providing a differentiated measured gas temperature signal having a magnitude indicative thereof, said threshold means comparing for exceedence the magnitude of said differentiated measured gas temperature signal to the magnitude of said temperature rate of change signal and incrementing said counter value upon an exceedence thereby.

19. The apparatus of claim 18, wherein said signal processing means further comprises means, responsive to said measured gas temperature signal and said corrected compressor speed signal, for providing an expected measured gas temperature signal having a magnitude indicative thereof, said threshold means comparing for exceedence the magnitude of said expected measured gas temperature signal to the magnitude of a selected one of said threshold signals and incrementing said counter value upon an exceedence thereby.

20. The apparatus of claim 6, wherein said signal processing means further comprises means for integrating over time said reference signal and for providing an integrated reference signal having a magnitude indicative thereof, said threshold means comparing for exceedence the magnitude of said integrate reference signal to the magnitude of a selected one of said threshold signals and incrementing said counter value upon an exceedence thereby.

* * * * *